US011085340B2

(12) United States Patent
Manteufel

(10) Patent No.: US 11,085,340 B2
(45) Date of Patent: Aug. 10, 2021

(54) VARIABLE STROKE GAS EXCHANGE VALVE TRAIN OF AN INTERNAL COMBUSTION ENGINE

(71) Applicant: Schaeffler Technologies AG & Co. KG, Herzogenaurach (DE)

(72) Inventor: Arne Manteufel, Herzogenaurach (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 16/494,819

(22) PCT Filed: Mar. 23, 2018

(86) PCT No.: PCT/DE2018/100264
§ 371 (c)(1),
(2) Date: Sep. 17, 2019

(87) PCT Pub. No.: WO2018/171843
PCT Pub. Date: Sep. 27, 2018

(65) Prior Publication Data

US 2020/0271025 A1 Aug. 27, 2020

(30) Foreign Application Priority Data

Mar. 24, 2017 (DE) ..... 10 2017 106 350.1

(51) Int. Cl.
*F01L 1/34* (2006.01)
*F01L 13/00* (2006.01)
(Continued)

(52) U.S. Cl.
CPC ..... *F01L 13/0036* (2013.01); *F01L 1/026* (2013.01); *F01L 1/047* (2013.01); *F01L 2013/0052* (2013.01)

(58) Field of Classification Search
CPC ..... F01L 13/0036; F01L 1/026; F01L 1/047; F01L 2013/0052
See application file for complete search history.

(56) References Cited

U.S. PATENT DOCUMENTS 8,701,610 B2 * 4/2014 Schwarzenthal ..... F01L 1/047 123/90.18
9,038,583 B2 * 5/2015 Stolk ..... F02D 13/00 123/90.16
(Continued)

FOREIGN PATENT DOCUMENTS

DE 102004024219 A1 1/2006
DE 102008054254 A1 5/2010
(Continued)

*Primary Examiner* — Zelalem Eshete

(57) ABSTRACT

The disclosure relates to a valve train of an internal combustion engine having variable-lift gas exchange valves, comprising: a carrier shaft, a cam piece arranged on the carrier shaft in a rotationally fixed and axially displaceable manner. The cam piece comprises a cam group of axially adjacent cams of different elevations, and an axial slotted link having axially opposite displacement grooves, each having a displacement region and an outlet region. Actuator pins, by engaging with the displacement grooves, displace the cam piece on the carrier shaft. Each displacement groove axially delimits, partially or completely, the outlet region by only one groove wall, and the one groove wall, at which the actuator pin, which is in engagement with the displacement region, positively accelerates the cam piece into a displacement direction. The width of the displacement grooves is smaller in the outlet region than a diameter of the actuator pins.

19 Claims, 4 Drawing Sheets

(51) Int. Cl.
*F01L 1/02* (2006.01)
*F01L 1/047* (2006.01)

(56) References Cited

U.S. PATENT DOCUMENTS

| | | | | |
|---|---|---|---|---|
| 2005/0011480 | A1* | 1/2005 | Schultz | F01L 13/0036 123/90.16 |
| 2010/0224154 | A1* | 9/2010 | Elendt | F01L 13/0036 123/90.17 |
| 2011/0132327 | A1 | 6/2011 | Koji et al. | |
| 2015/0204219 | A1 | 7/2015 | Akitomo et al. | |

FOREIGN PATENT DOCUMENTS

| | | | |
|---|---|---|---|
| DE | 102010033087 | A1 | 2/2012 |
| DE | 102013220554 | A1 | 4/2015 |
| DE | 102013019260 | A1 | 5/2015 |
| EP | 1503048 | A1 | 2/2005 |

* cited by examiner

VARIABLE STROKE GAS EXCHANGE VALVE TRAIN OF AN INTERNAL COMBUSTION ENGINE

CROSS-REFERENCE TO RELATED APPLICATIONS

This application is the U.S. National Phase of PCT Application No. PCT/DE2018/100264 filed on Mar. 23, 2018 which claims priority to DE 10 2017 106 350.1 filed on Mar. 24, 2017, the entire disclosures of which are incorporated by reference herein.

TECHNICAL FIELD

This disclosure relates to a valve timing gear of an internal combustion engine having variable-lift gas exchange valves, comprising:

a carrier shaft, an axially displaceable cam piece arranged and rotationally fixed on the carrier shaft, having a cam group of axially adjacent cams of different lobe lifts and an axial link having axially opposed displacement grooves, each having a displacement area and a outlet area successively in the direction of rotation of the cam, and cylindrical actuator pins, which, in engagement with the displacement grooves, displace the cam piece on the carrier shaft.

Here each displacement groove axially defines part or all of the outlet area by way of only one groove wall, that on which the actuator pin in engagement with the displacement area positively accelerates the cam piece into the present displacement direction.

BACKGROUND

As is generally known, a so-called sliding-cam valve gear is a variable-lift gas exchange valve timing gear of an internal combustion engine, the variable lift of which is produced by the axial displacement of a cam piece with cams of different lobe lifts on a rotationally driving carrier shaft. Here the associated gas exchange valve is selectively actuated by one of the cams of a cam group according to the axial position of the cam piece on the carrier shaft. The cam piece is displaced by means of actuator pins, which engage alternately in an axial link of the cam piece with two axially opposed displacement grooves and displace the (rotating) cam piece between the axial positions according to the axial path of the displacement grooves.

The displacement grooves are situated next to the cams, so that the length of the cam piece depends on the width of the cam group, i.e. the number and width of the individual cams, and on the width of the axial link.

DE 10 2004 024 219 A1 of generic type discloses a cam piece having an axial link, which is of relatively narrow construction in that a part of the displacement groove in the outlet area is axially defined by only one groove wall.

SUMMARY

The object of the present disclosure is to specify a valve timing gear of the generic type having a cam piece, the overall dimensions of which lengthwise are further reduced, making it suitable even for small internal combustion engines with relatively little overall axial space available for the cam piece.

According to the disclosure this object is achieved in that the width of the displacement grooves in their outlet area is smaller than the diameter of the actuator pins. The further reduction in the overall space taken up by the axial link compared to the prior art cited is therefore achieved in that each displacement groove in the part of the outlet area that is axially open with only one defining groove wall is narrower than the diameter of the actuator pin.

This means, on the one hand, that in the axially open outlet area of the displacement grooves, that groove wall on which the (inactive) cam piece is supported by the actuator pin under negative acceleration, i.e. decelerating in the displacement direction, is partially or completely eliminated. Since any adjoining residual wall thickness of the axial link is also eliminated along with this groove wall, the reduction in the length of the axial link is twice this residual wall thickness. Since, on the other hand, the outlet areas are narrower by a differential amount than the diameter of the actuator pins, there is an additional reduction in the length of the axial link of twice this differential amount.

In this design development, the function of the non-existent groove walls in this area in retarding the cam piece is substantially assumed by an already necessary detent, which locks the cam piece in the respective axial position relative to the carrier shaft and slows it during the process of engagement. As an addition or alternative, the cam piece may be slowed by a camshaft bearing, which serves as stop for the cam piece.

In a development of the disclosure, the cam piece should have two cam groups, which axially adjoin both sides of the (centrally interposed) axial link. Such a cam piece is typical for valve timing gears in which the carrier shaft is supported not between the two inlet or exhaust valves of a cylinder, but between the cylinders of the internal combustion engine.

In addition, the displacement grooves may each have a inlet area preceding the displacement area in the direction of rotation of the cam. In this case the inlet area has a radius of the groove base decreasing in the direction of rotation of the cam, the displacement area has a constant radius of the groove base, and the outlet area has a radius of the groove base increasing in the direction of rotation of the cam. The axial distance of the outlet areas is greater than the axial distance of the inlet areas. In the case of the aforementioned central axial link this diverging axial path of the displacement grooves means that in the outlet areas the actuator pins axially overlap with the cams rotating there. This affords the option of transporting the actuator pin, still extended towards the displacement groove after each displacement operation of the cam piece, back into the actuator by means of the then passing cam lobe.

BRIEF DESCRIPTION OF THE DRAWINGS

Further features of the disclosure emerge from the following description and from the figures showing two exemplary embodiments. Unless otherwise stated, the same or functionally equivalent features or components are here provided with the same reference numerals. In the drawings.

DETAILED DESCRIPTION

Figure 1:
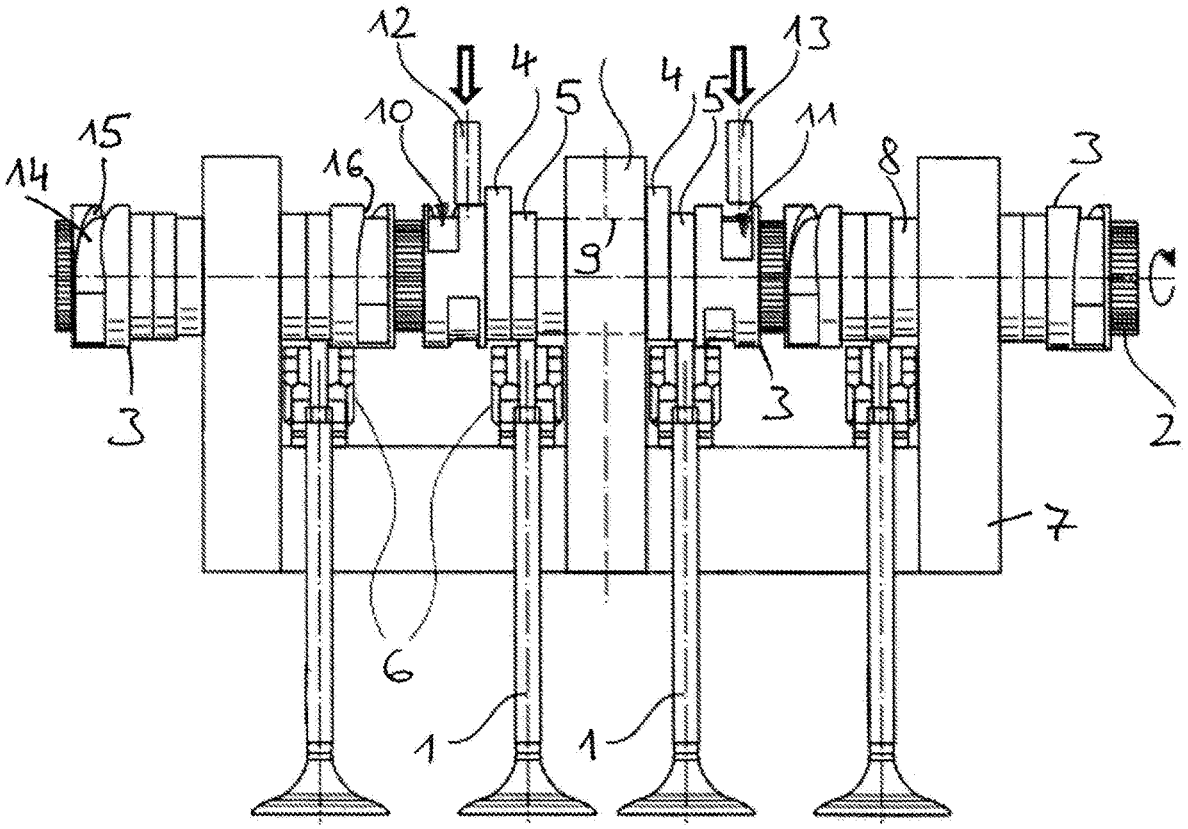
Fig. 1 (Prior Art)
FIG. 1 shows a known sliding-cam valve timing gear.

The disclosure will be explained with reference to FIG. 1, which shows a known valve timing gear of a multi-cylinder internal combustion engine having variable-lift actuation of the gas exchange valves 1. The basic working principle of the valve timing gear can be summarized by saying that a camshaft of conventionally rigid design is replaced by an externally toothed carrier shaft 2 and cam pieces 3 rotationally fixed thereon by means of internal toothing and here supported so that they are axially displaceable between two positions. Each cam piece 3 comprises two cam groups of axially directly adjacent cams 4 and 5, the different cam lobe lifts of which are transmitted to the gas exchange valves 1 by means of finger-type rockers 6. The carrier shaft 2 is supported in the cylinder head 7 of the internal combustion engine by way of the cam pieces 3, which are each radially supported by a cylindrical circumferential portion 8 so that they are axially displaceable between the two cam groups in a camshaft bearing 9 of the cylinder head 7. The camshaft bearings 9 are each situated between two gas exchange valves 1 of the same type, i.e. between two inlet valves or exhaust valves of the same cylinder.

The displacement of each of the cam pieces 3 on the carrier shaft 2 required for activation of the respective cam 4 or 5 as a function of the operating point is undertaken via an axial link with helical displacement grooves 10 and 11, which run circumferentially on both ends of the cam piece 3. Depending on the current axial position of the cam piece 3, a cylindrical actuator pin 12 or 13 of an actuator (not shown), fixed to the cylinder head, engages in each of the displacement grooves 10 and 11, which run in opposite axial directions corresponding to their opposing displacement directions, according to the direction of the arrow indicated, and displaces the cam piece 3 rotating with the carrier shaft 2 into the other axial position. With a groove base 14 and opposing groove walls 15 and 16, the displacement grooves 10, 11 each have a U-shaped cross section over their entire circumferential extent.

The cam pieces 3 are locked to the carrier shaft 2 in both axial positions. This is achieved by means of a known detent device, not visible here. This is usually in each instance a spring-loaded ball in a transverse bore of the carrier shaft 2, which engages in axial adjacent inside grooves in the cam piece 3.

Figure 2:
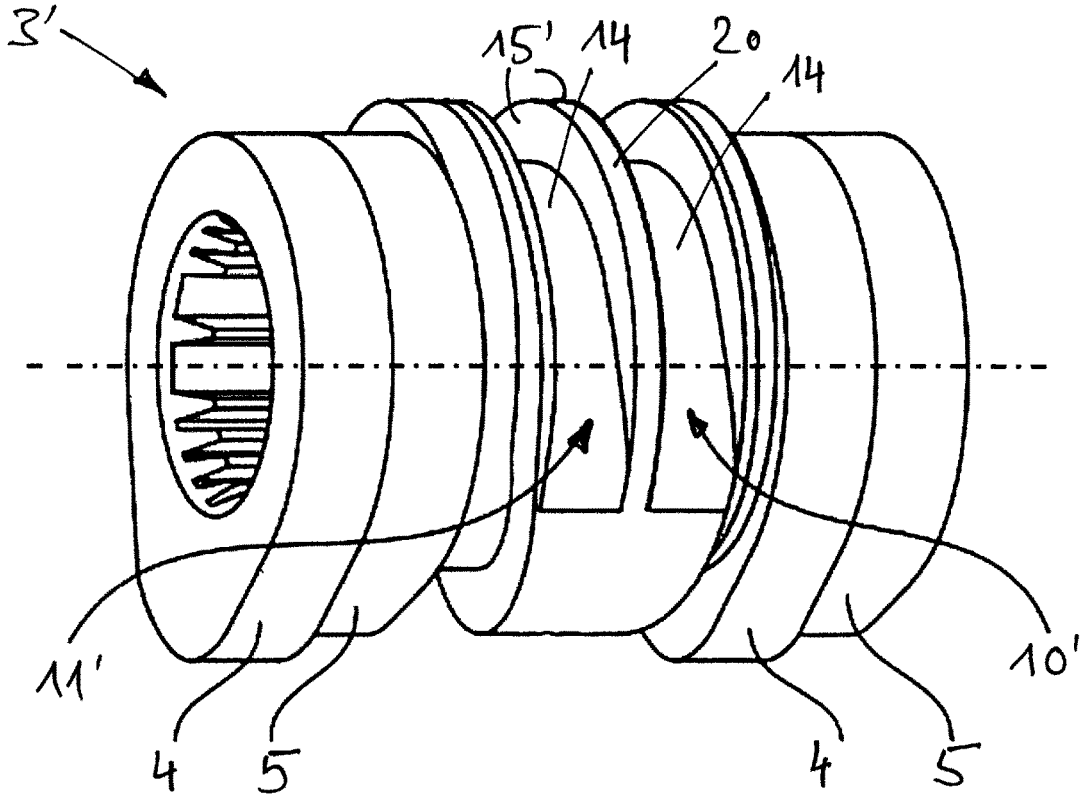
FIG. 2 shows a perspective representation of the first exemplary embodiment of a cam piece according to the disclosure.

The first exemplary embodiment of a cam piece 3' according to the disclosure represented in FIG. 2 differs from the known cam piece 3 according to FIG. 1 in several respects. The cam piece 3' is supported on a carrier shaft not between the inlet or exhaust valves of one cylinder but between the cylinders of the internal combustion engine. Consequently, it is not the cam piece 3' but rather the carrier shaft which is supported directly in camshaft bearings of the cylinder head. The axial link is not situated at both ends of the cam piece 3' but between the two cam groups, each comprising the cams 4 and 5, so that the two displacement grooves 10' and 11' are directly adjacent.

The overall space remaining for the axial link between the cam groups axially adjacent thereto on both sides results from the spacing of the currently active cam 4 or 5, identical to the spacing between the inlet or exhaust valves, and the width of the cams 4 and 5. The cam width at the same time is instrumental in determining the axial rise of each displacement groove 10' and 11'. Since in internal combustion engines with a relatively small cylinder bore the valve spacing is correspondingly small and the cams 4, 5 have a mechanically determined minimum width, the overall space available for an axial link with fully circumferential U-shaped displacement grooves 10, 11 according to FIG. 1 is sometimes too small.

Figure 3:
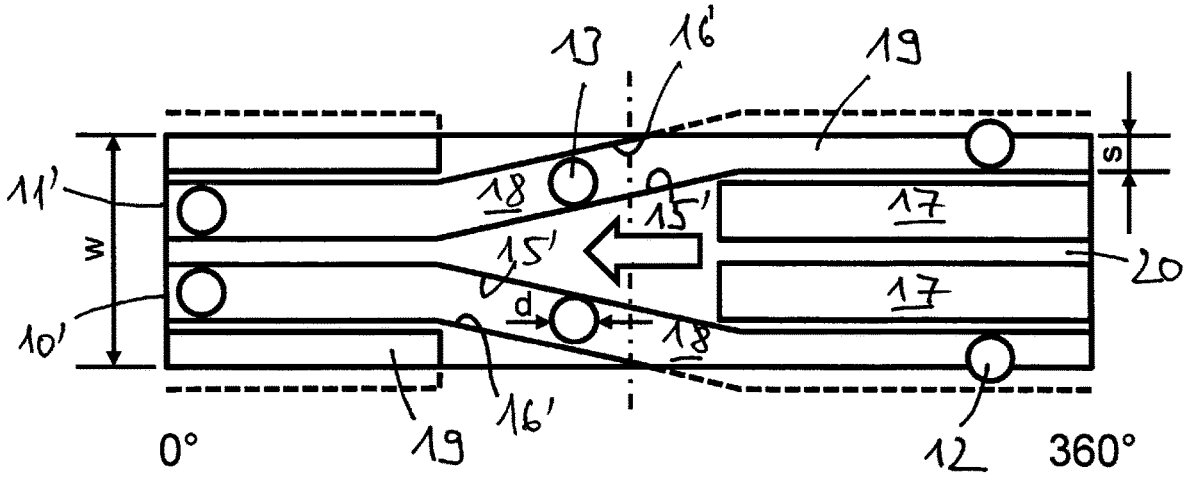
FIG. 3 shows a schematic representation of an extensive development of an axial link according to the disclosure.

FIG. 3 illustrates the solution to this problem of overall space through a schematic 360° development of the axial link according to FIG. 2. This represents the two mirror-symmetrical displacement grooves 10', 11' and the two actuator pins 12 and 13, alternately engaging therein, each in three different relative positions to the axial link, which rotates in the direction of rotation of the cam identified by the arrow. Each displacement groove 10', 11' comprises a inlet area 17, a displacement area 18 and a outlet area 19 successively in the direction of rotation of the cam for the actuator pin 12 or 13 engaging therein. In the inlet area 17 the groove base 14 (see FIG. 2) has a radius continuously decreasing in the direction of rotation of the cam, and in the outlet area 19 a radius continuously increasing in the direction of rotation of the cam, in order to actively transport the actuator pin 12 or 13 out of the displacement groove 10' or 11' at the end of the displacement operation. The displacement area 18 has a constant radius of the groove base 14.

Compared with the known axial link according to FIG. 1, the reciprocal axial path of the two displacement grooves 10', 11' is divergent in the direction of rotation of the cam. This is because the displacement grooves 10', 11' do not run axially towards one another, but away from one another, so that the outlet areas 19 have a greater axial distance than the inlet areas 17. The inlet areas 17 are axially separated from one another only by a web 20 (see also FIG. 2), the width of which is substantially smaller than the diameter d of the actuator pins 12 and 13. The width of the web 20, which in the inlet area 17 may also optionally be dispensed with, is obtained, for reasons to do with the strength of the material, from a minimum axial distance between the two closest adjacent groove walls 15' (see also FIG. 2), on which the actuator pins 12, 13 in the displacement area 18 positively accelerate the cam piece 3' into the current displacement direction. The inlet area 17 and the outlet area 19 circumferentially overlap one another, so that the circumferential angle of the displacement grooves 10', 11' is substantially greater than 360°.

The reduced width w of the axial link compared to known axial links results from the fact the displacement grooves 10' and 11', at least in the area of the outlet areas 19, are virtually cut off axially to such a degree that the displacement grooves 10', 11' axially define part or all of their outlet areas 19 solely by way of the closest adjacent groove walls 15' and that there the width s of the displacement grooves 10', 11' is smaller than the diameter d of the cylindrical actuator pins 12, 13. In the present exemplary embodiment all of the outlet areas 19 and part of the displacement areas 18, that is to say in the transitional area to the outlet areas 19, are axially defined solely by way of the groove walls 15'. This fact is illustrated in FIG. 3 by the dashed representation of some of the groove walls 16', non-existent in this area.

The axial overlapping of the engaged actuator pins 12, 13 with the cams 4 and 5 is not harmful if the actuator pin 12, 13 is transported out of the rotational area of the cam lobe by the actuator and/or by the groove base 14 radially rising in the direction of rotation of the cam, before a collision with the rotating cams 4, 5. Alternatively a cam collision may even be desirable if the lobe of the rotating cam 4, 5 transports the actuator pin 12 or 13 out of the cam rotational area in a controlled manner, i.e. with a mechanically acceptable load stress.

The partial absence of the groove walls 16' exercising negative acceleration, i.e. retarding the cam piece 3' in the current displacement direction is compensated for by the aforementioned detent device, which retards the cam piece 3' until it engages in its new axial position. Alternatively or in addition to this, the cam piece 3' may also strike against the adjacent camshaft bearings, if necessary, with hydraulic or mechanical impact damping.

Figure 4:
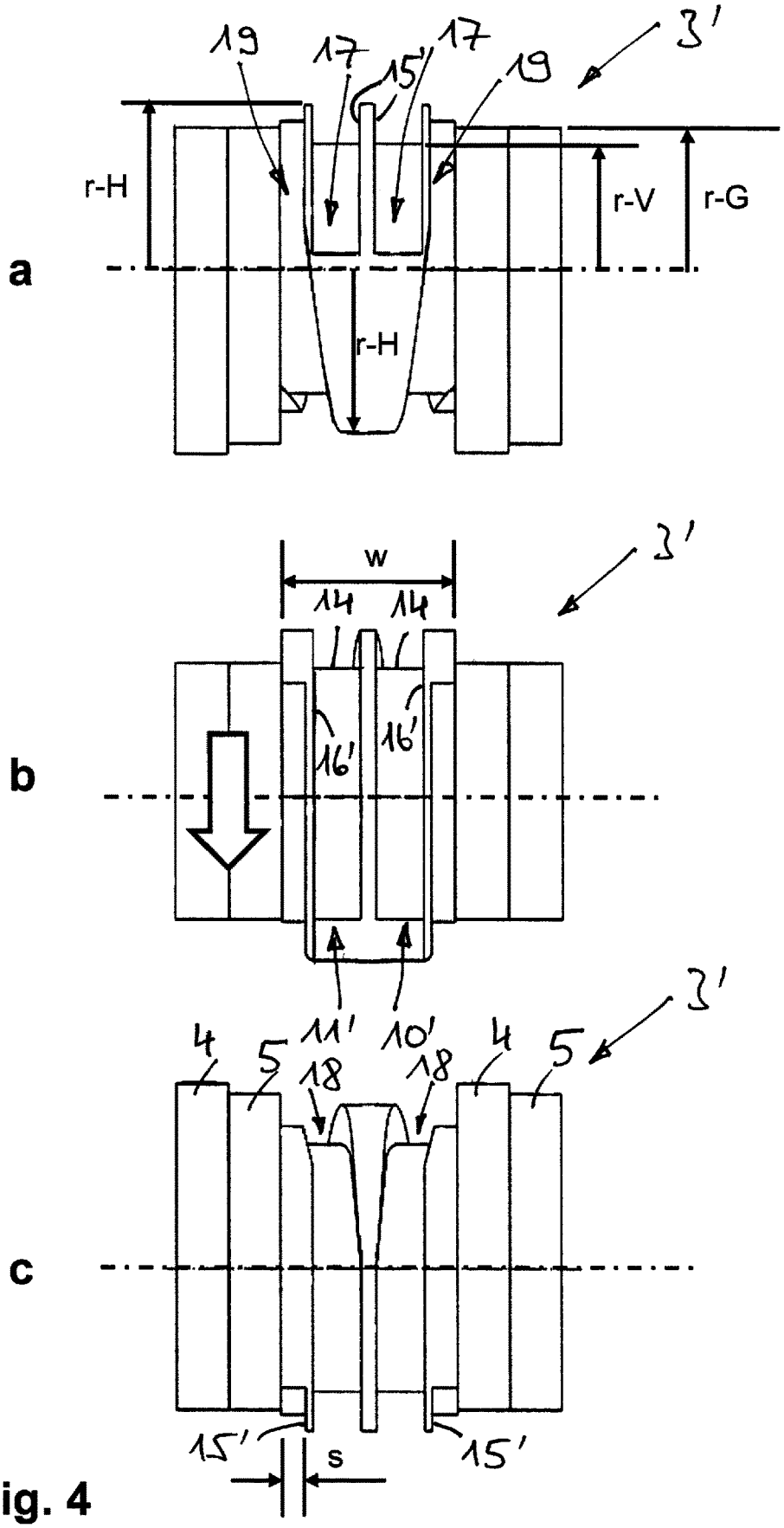
FIG. 4 shows a top view of the cam piece according to FIG. 2 in different rotational positions, as depicted by views a, b, and c.

FIG. 4 shows top views of the cam piece 3' according to FIG. 2 in different rotational positions, as depicted in views a, b, and c. These views illustrate the circumferential path of the displacement grooves 10' and 11' and the partial absence of the retarding groove walls 16' and 16".

In the figures:

r-G: denotes the radius of the (lobe-free) base circle of the cams 4, 5 r-H: denotes the high circle radius of the axial link r-V: groove base radius in the displacement area In the inlet area 17 the radius of the groove base 14 decreases in the direction of rotation of the cam indicated, from the high circle radius r-H to the groove base radius r-V, which in the displacement area 18 is constant and smaller than the cam base circle radius r-G. In the outlet area 19 the groove base radius increases from r-V back to the high circle radius r-H.

The relationship r-H>r-G applies, moreover, because the actuator pins 12 and 13 axially overlapping with the cams 4 and 5 respectively in the outlet area 19 must have radial free travel relative to the cams 4 and 5 by the time the relative position of the incipient overlap is reached. The high circle radius r-H is thereby always greater than the cam base circle radius r-G.

Figure 5:
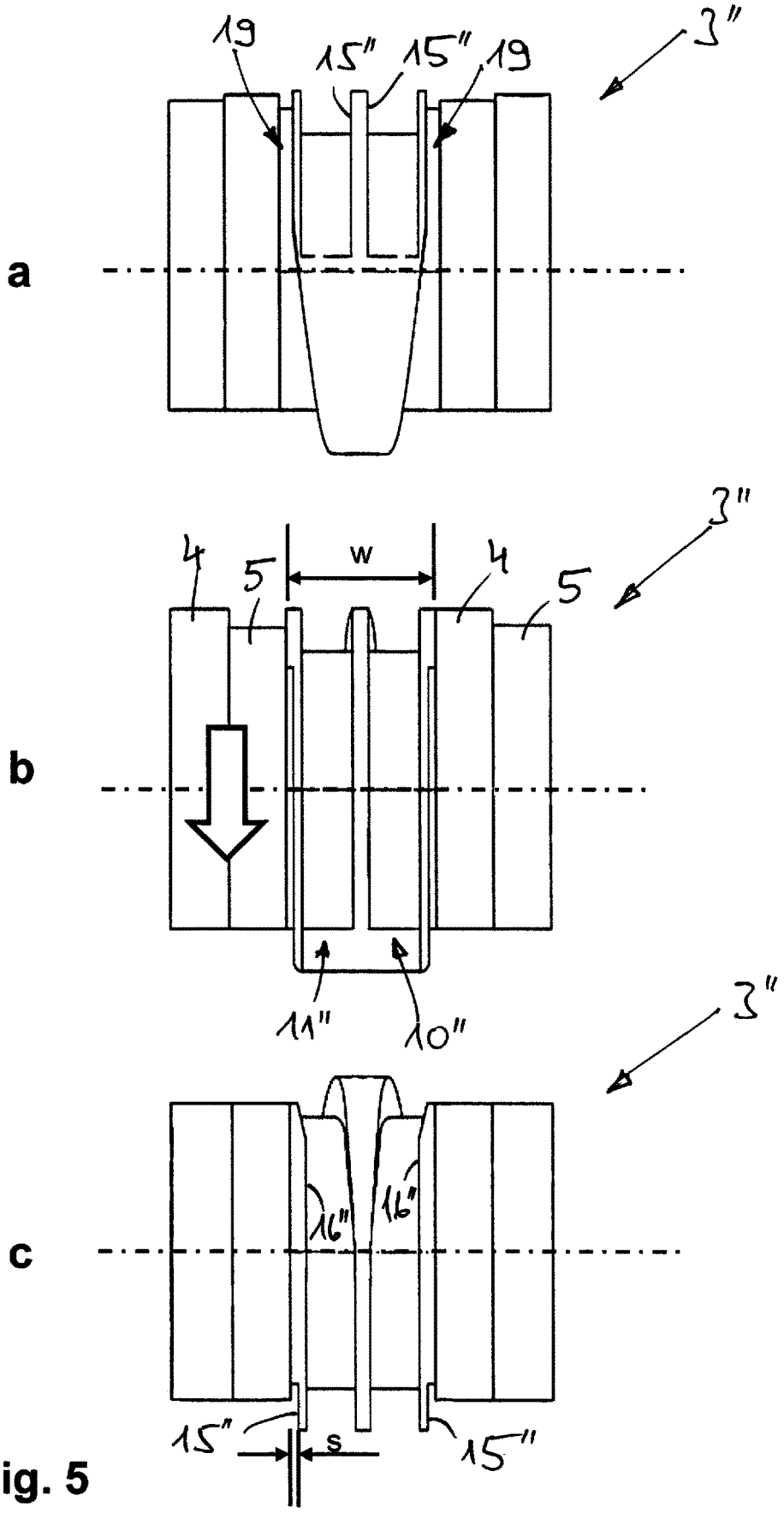
FIG. 5 shows a top view of the second exemplary embodiment of a cam piece according to the disclosure in different rotational positions, as depicted by views a, b, and c.

The second exemplary embodiment of a cam piece 3" according to the disclosure similarly represented in FIG. 5 differs from the first exemplary embodiment firstly through the significantly smaller width s of the displacement grooves 10", 11" in the outlet area 19 and through the accordingly smaller width w of the axial link. Secondly, the lobes of the cams 4 and 5 are situated at an earlier circumferential position relative to the outlet areas 19 in the direction of rotation of the cam, so that the rotating cam lobes actively transport the actuator pins 12 and 13 back into the actuator.

The invention claimed is:

1. A valve timing gear of an internal combustion engine having variable-lift gas exchange valves, the valve timing gear comprising:

a carrier shaft, an axially displaceable cam piece arranged and rotationally fixed on the carrier shaft, the axially displaceable cam piece having at least one cam group of axially adjacent cams of different lobe lifts and an axial link having axially opposed displacement grooves, each displacement groove having a displacement area and an outlet area successively in a direction of rotation of the cam piece, and cylindrical actuator pins, which, in engagement with the displacement grooves, displace the cam piece on the carrier shaft, and each displacement groove axially defines at least part of the outlet area by way of only one groove wall, that on which the actuator pin in engagement with the displacement area positively accelerates the cam piece into a displacement direction, and a width of the displacement grooves in their respective outlet areas is smaller than a diameter of the actuator pins.

2. The valve timing gear as claimed in claim 1, wherein the cam piece has two cam groups, which axially adjoin both sides of the axial link.

3. The valve timing gear as claimed in claim 1, wherein the displacement grooves each have an inlet area preceding the displacement area in the direction of rotation of the cam, and the inlet area has a radius of a groove base decreasing in the direction of rotation of the cam, the displacement area has a constant radius of the groove base and the outlet area has a radius of the groove base, increasing in the direction of rotation of the cam, and an axial distance of the outlet areas is greater than an axial distance of the inlet areas.

4. The valve timing gear as claimed in claim 3, wherein the inlet areas are axially separated from one another by a web, a width of the web substantially smaller than a diameter of the actuator pins.

5. The valve timing gear as claimed in claim 1, wherein each displacement groove axially defines part of the displacement area and all of the outlet area by way of only the one groove wall.

6. A valve timing gear of an internal combustion engine, the valve timing gear comprising:

a carrier shaft, an axially displaceable cam piece arranged to rotate with the carrier shaft, the axially displaceable cam piece including:

at least one cam group of axially adjacent cams of different lobe lifts, an axial link having at least one displacement groove, the at least one displacement groove having a displacement area and an outlet area successively in a direction of rotation of the cam piece, and the at least one displacement groove axially defining at least part of the outlet area by way of only one groove wall, the one groove wall configured to engage with at least one actuator pin to positively accelerate the cam piece in a displacement direction, the at least one actuator pin having a width greater than a width of the at least part of the outlet area.

7. The valve timing gear as claimed in claim 6, wherein the at least one cam group comprises a first cam group and a second cam group, and the axial link is arranged between the first and second cam groups.

8. The valve timing gear as claimed in claim 6, wherein the at least one displacement groove axially defines part of the displacement area and all of the outlet area by way of only the one groove wall.

9. The valve timing gear as claimed in claim 6, wherein the at least one displacement groove further comprises an inlet area that circumferentially overlaps with the outlet area.

10. The valve timing gear as claimed in claim 9, wherein a radius of a base of the at least one displacement groove in the inlet area decreases in the direction of rotation.

11. The valve timing gear as claimed in claim 10, wherein a radius of a base of the at least one displacement groove in the outlet area increases in the direction of rotation.

12. The valve timing gear as claimed in claim 11, wherein a radius of a base of the displacement groove in the displacement area is constant.

13. The valve timing gear as claimed in claim 6, wherein the at least one actuator pin comprises a first actuator pin and a second actuator pin, and the at least one displacement groove comprises a first displacement groove configured to be moved by the first actuator pin in a first axial direction, and a second displacement groove configured to be displaced by the second actuator pin in a second axial direction, opposite the first axial direction.

14. A valve timing gear of an internal combustion engine, the valve timing gear comprising:

a carrier shaft, and an axially displaceable cam piece configured to rotate with the carrier shaft, the axially displaceable cam piece including:

at least one cam group of axially adjacent cams of different lobe lifts, an axial link having at least one displacement groove configured to engage an actuator pin to positively accelerate the cam piece into a displacement direction, the at least one displacement groove having a displacement area and an outlet area successively in a direction of rotation of the cam piece, and at least part of the outlet area defined by only one groove wall, such that a width of the at least part of the outlet area is configured to be less than a width of the actuator pin.

15. The valve timing gear of claim 14, wherein the at least one displacement groove includes a first displacement groove and a second displacement groove, the second displacement groove axially opposed to the first displacement groove.

16. The valve timing gear of claim 14, wherein the at least one displacement groove further comprises an inlet area.

17. The valve timing gear of claim 16, wherein at least part of the displacement area is defined by a U-shaped cross-section.

18. The valve timing gear of claim 17, further comprising the actuator pin, and the actuator pin is a cylindrical pin having a diameter greater than the width of the at least part of the outlet area.

19. The valve timing gear of claim 14, wherein the outlet area is arranged at an end of the at least one displacement groove.

* * * * *